United States Patent [19]

Wünnenberg

[11] 4,022,369

[45] May 10, 1977

[54] CURVED ROLLER TRACK FOR CONTINUOUSLY CAST INGOTS

[75] Inventor: Klaus Wünnenberg, Duisburg, Germany

[73] Assignee: Mannesmann Aktiengesellschaft, Dusseldorf, Germany

[22] Filed: Jan. 21, 1976

[21] Appl. No.: 651,188

[30] Foreign Application Priority Data

Jan. 31, 1975 Germany ..... 2504558

[52] U.S. Cl. ..... 226/189; 164/282; 193/35 R

[51] Int. Cl.[2] ..... B65H 17/20; B65G 13/02; B22D 11/12

[58] Field of Search ..... 164/82, 282, 283, 89, 164/274; 193/35 R; 226/189

[56] References Cited

UNITED STATES PATENTS

| | | | |
|---|---|---|---|
| 3,642,058 | 2/1972 | Webbere | 164/283 |
| 3,645,323 | 2/1972 | Vogt | 164/282 |

FOREIGN PATENTS OR APPLICATIONS

| | | |
|---|---|---|
| 1,166,334 | 1/1967 | United Kingdom |

*Primary Examiner*—Richard B. Lazarus
*Assistant Examiner*—John S. Brown
*Attorney, Agent, or Firm*—Ralf H. Siegemund

[57] ABSTRACT

An ingot is guided and supported, after exiting from the mold, along a curved path, in which smaller, closer spaced and more numerous rollers are arranged on the inside - upper side of the track path than on the underside - outside thereof. The track is segmented, each segment holding the same number of rollers for inside and outside track portion, but the inside track is supplemented by inbetween- segment rollers.

6 Claims, 3 Drawing Figures

CURVED ROLLER TRACK FOR CONTINUOUSLY CAST INGOTS

BACKGROUND OF THE INVENTION

The present invention relates to a roller track for guiding an ingot from the bottom opening of a mold for continuous casting, along a curved path for continued withdrawing in the horizontal.

The ingot exiting from a continuous casting mold has a just barely solidified outer shell or skin and is still liquidous in its interior. The skin is not only thin at first but the liquid core exerts a ferrostatic pressure tending to bulge the skin, which, of course, may rupture. Thus, the ingot must be carefully supported until solidified completely.

It is customary to support the ingot by means of roller tracks engaging the ingot, e.g. from above as well as from below; that is to say, on the inside as well as on the outside of the curved withdrawal path. Still some bulging is inevitable and depends on the distance from roller to roller, on the skin temperature and thickness, and on the ferrostatic pressure. The latter depends on the height of the machine because the molten metal forms a liquid column that reaches down from the surface level of the molten metal in the mold to the lowest horizontal level of still liquidous metal in the core of the continuous cast ingot. One has only a limited degree of control here; reducing the height of the column requires a sharper curving of the withdrawal path, but obviously there are limitations present here; the curving must be rather gradual.

The skin temperature can and will be reduced by so-called secondary cooling, e.g. vigorous spray cooling the ingot from the outside as it exits from the mold and over a long portion of the withdrawal path. However, some grades of steel are not amenable to very strong cooling from the outside. Spraying water onto the emerging ingot amounts to a local quenching and may cause formation of cracks. In other words, steel requires a more gradual cooling, but this delay inherently increases the tendency to bulge. On the other hand, it should be noted that due to the geometry involved, one can apply more cooling water to the underside (outward curving) than to the upper side without producing larger fissures.

The withdrawal rollers should be placed next to each other as close as possible, but clearly there are limitations here resulting from the physical dimensions of the rollers. Of course, the main point is to decrease the distance between points of support, and that can be achieved by making the rollers smaller. However, if the rollers are too thin, they bend of their own accord. One has used, therefore, split rollers, i.e. rollers of axially short dimensions. However, the support of such rollers was found to be quite different and complex, particularly if used throughout both roller track portions.

The known roller tracks have usually similar rollers and a similar number of rollers on the inside — upper side as well as on the outside — underside. The distances are slightly different due to the curvature of the track, but the track curves quite gradually and the number or rolls is usually quite large, so that that difference is insignificant.

DESCRIPTION OF THE INVENTION

It is an object of the present invention to improve roller tracks for supporting and guiding a continuously cast ingot particularly in the curved portion of the track, so that bulging of the skin and, therefore, internal cracks and fissure in the surface of the ingot can be avoided or at least diminished in size and number.

The invention is based on the recognition that, other conditions being similar, the outside — underside of a curving ingot is less prone to experience fissures and cracks due to bulging under ferrostatic pressure. In accordance with the preferred embodiment of the present invention it is suggested to provide larger support rolls and in smaller numbers along the outside and lower side of the curved roller track path, as compared with the rolls along the inside and upper side of that path. Axially divided rollers do not have to be used in the outside track, as the rollers are sufficiently thick, but divided rollers may be used on the inside track path. Thus, the inside surface portion (as regards curving) of the ingot is supported in more closely positioned points on account of the larger number (per unit length) of rollers. These points are closer than would naturally result from the shorter curve path length along the inside of the ingot.

The roller track, particularly the curved portion is preferably segmented, each segment holding several rolls for the outside track and several for the inside track, whereby one more roll is used for the latter track portion. However, in the preferred form of practicing the invention, each segment holds the same number of rollers for inside and outside tracks, but the former are smaller and arranged closer together, and one additional roller per segment or one per two segments is used to supplement and to complete the inside track path; these additional rollers are mounted (and removable!) separately to facilitate installation and removal of the segments.

It can thus be seen that the inside surface of the ingot will be supported by a larger number of support points established through engagement with smaller and closer spaced rollers, than the outside surface. It was found that this way the tendancy of the ingot shell to bulge is more uniformly distributed so that actual bulging is significantly diminished, and the tendency to form cracks and fissures is better controlled accordingly.

DESCRIPTION OF THE DRAWING

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 shows a roller track for guiding and supporting a continuously cast ingot 5, preferably a slab ingot withdrawn from a mold 4. Throughout the track, the same number of rollers are used above and on the inside portion of the curved track path (rollers 3) as well as below and on the outside portion of that path (rollers 2). Specifically, the curved portion shows groups of rollers supported in segments or support elements 1. As usual, each roller 2 on the outside faces a roller 3 on the inside so that the distance between the latter is slightly smaller in proportion to the difference in geometric path length along the upper and lower sides of ingot 5.

FIG. 2 shows how the machine of FIG. 1 can be improved. The figure shows support segments 12 each holding a plurality of rollers for defining a segment of the curved roller track portion. Each segment holds five rollers 7 for the outside track and five smaller rollers 6 for the inside track portion. The rollers 6 are sufficiently small so that they are closer by about 20% as compared with the distance from roll to roll of the rollers 7, (again, not counting the "natural" geometric difference in path length). The radius of curvature of the track may, for example, be about 12 meters. Accordingly, a gap exists from segment to segment along the inside track, and separate rollers 8 are placed and mounted individually to fill the gaps so that the rollers in the track are evenly spaced including spacing from segment to segment. These rollers 8 are equal in size and spacing to the roller 6 accordingly. The reason for merely associating these rollers with the segments and not mounting them on the respective segment is to facilitate installation and removal of both; the supplemental rollers 8 can be removed separately which in turn facilitates removal of the respective adjacent segments.

It can thus be seen that for each five larger rollers 7 on the outside track there are six smaller rollers 6, 8 on the inside. This difference is maintained at least throughout a major portion of the curved track portion. This difference does not have to be continued in the horizontal track, and the difference in rollers needs to be provided only adjacent to ingot portions still having a liquidous core.

Figure 1:
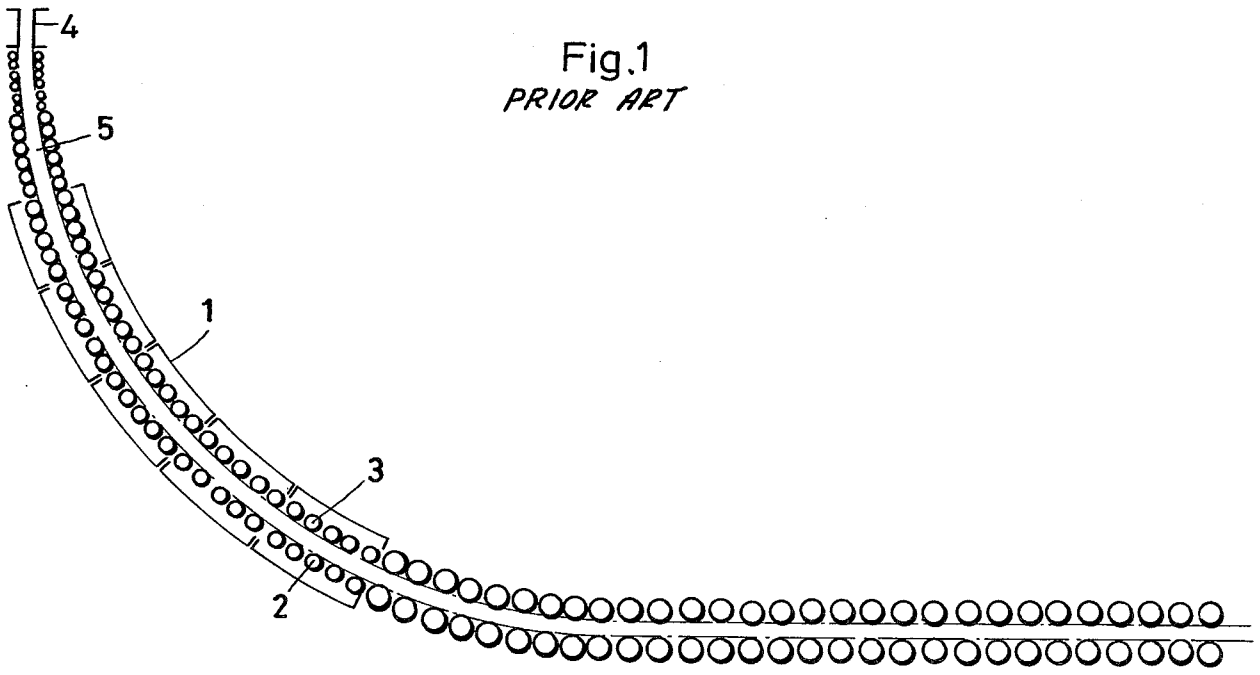
Fig.1 PRIOR ART
FIG. 1 is a somewhat schematic side view of a known roller track for guiding and withdrawing a continuously cast ingot.
Figure 2:
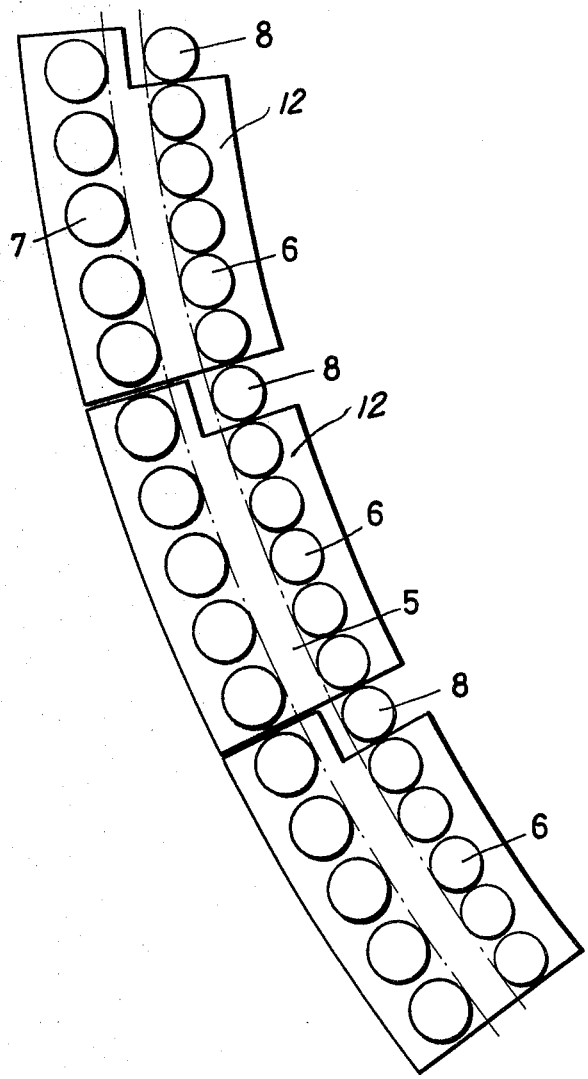
FIG. 2 is a portion of such roller track, but improved in accordance with the preferred embodiment of the invention.
Figure 3:
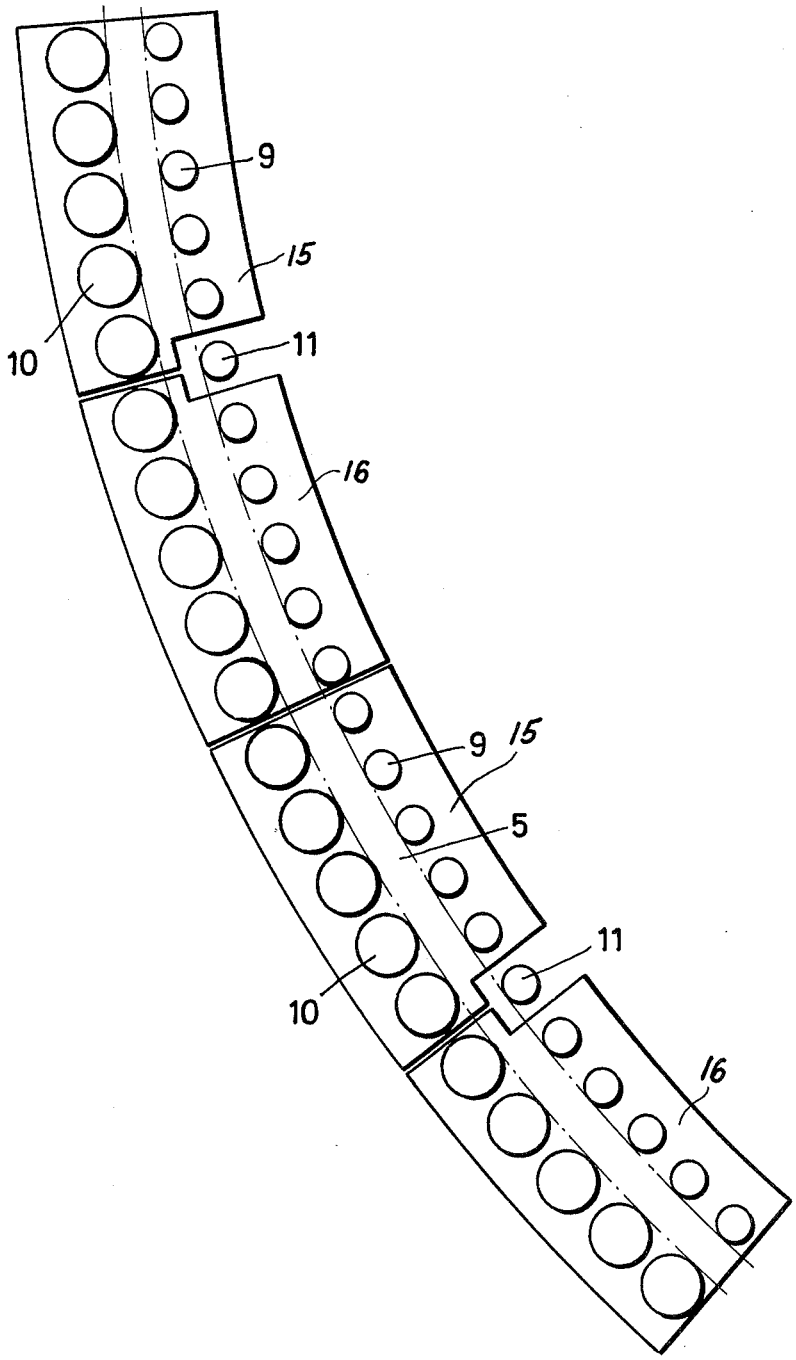
FIG. 3 shows a portion of a roller track somewhat differently improved, but still in accordance with the preferred embodiment.

FIG. 3 shows modified segments 15, 16 differing in that each is the mirror image of the respective other one. Again, each segment has five large outside track rollers 10 and five closer spaced small inside track rollers 9. A supplemental roller 11 of like dimensions as rollers 9 is mounted in-between adjacent two segments, overlapping both of them. The roller spacing on the the inside track is also consistently uniform here. The arrangement is such that for each five rollers on the outside, there are five and-a-half rollers on the outside. Thus, in this case the roller-to-roller distance is reduced by about 10% (as compared with the spacing inherent in the arrangement as per FIG. 1). The arrangement and construction of segments in mirror image symmetry as per FIG. 3 has the added advantage that the segments can always be removed in upper direction; of course, after the supplemental rollers 11 have been removed in each instance.

It was found that an arrangement of support and guide rollers as shown above, i.e. with a different arrangement of rollers as to size and numbers for inside and outside track portions establishes conditions for equalizing any bulging throughout the skin of the ingot. Also, one does not need axially divided rollers on the outside. However, the rollers 6, 8, 9 and 11 may have to be axially divided if they would bend otherwise.

The invention is not limited to the embodiments described above, but all changes and modifications thereof not constituting departures from the spirit and scope of the invention are intended to be included.

I claim:

1. In a roller track for guiding and supporting an ingot as withdrawn from the bottom of a mold for continuous casting, the track having a curved portion to veer the ingot from a vertical direction of emergence into the horizontal, the track having first rollers on the inside and upper track portion of the curved path and as continued in the horizontal direction, and second rollers on the outside and lower track portion of the curved path and as continued in the horizontal direction, the improvement comprising:

The second rollers being consistently larger in diameter than some of the first rollers over at least a significant portion of said curved track path; and there being more first rollers than second rollers in said significant portion, so that the spacing between the first rollers is smaller than the spacing between the second rollers in addition to the difference in path length on account of curvature.

2. In a roller track as in claim 1, wherein the curved portion is divided into segments, each segment holding a particular plurality of the first and second rollers, but more first than second rollers associated with each said segment.

3. In a roller track as in claim 1, wherein the curved portion is divided into segments, each segment holding the same number of first and second rollers, there being additional first rollers in said inside and upper track.

4. In a roller track as in claim 3, there being one additional first roller for each said segment.

5. In a roller track as in claim 3, there being one additional first roller for each two segments, the segments being of mirror image construction with space for the additional first roller.

6. In a roller track as in claim 1, said first rollers being smaller being constructed as axially divided rollers.

* * * * *